US005346166A

United States Patent [19]

Valiulis

[11] Patent Number: 5,346,166

[45] Date of Patent: Sep. 13, 1994

[54] HEAVY DUTY HANGER ASSEMBLY WITH LABEL WINGS AND ORIENTING HOOKS

[75] Inventor: Stanley C. Valiulis, Rockford, Ill.

[73] Assignee: Southern Imperial, Inc., Rockford, Ill.

[21] Appl. No.: 109,964

[22] Filed: Aug. 23, 1993

[51] Int. Cl.[5] ..... A47B 91/06

[52] U.S. Cl. ..... 248/220.4; 248/301; 211/57.1; 211/59.1

[58] Field of Search ..... 248/220.3, 220.4, 222.1, 248/339, 300, 301, 304, 217.3; 211/57.1, 59.1, 113, 118, 72, 162

[56] References Cited

U.S. PATENT DOCUMENTS

| | | | |
|---|---|---|---|
| 1,291,001 | 1/1919 | Horwitz | 211/57.1 |
| 1,411,895 | 4/1922 | Allen | 211/57.1 |
| 2,729,411 | 1/1956 | Cahill | 248/300 |
| 2,757,890 | 8/1956 | Sutton et al. | 248/301 |
| 3,389,807 | 6/1968 | Morning et al. | 211/9 X |
| 4,823,964 | 4/1989 | Lundberg | 248/220.4 X |
| 4,938,368 | 7/1990 | Sharman | 211/57.1 |

*Primary Examiner*—David A. Scherbel
*Assistant Examiner*—Korie H. Chan
*Attorney, Agent, or Firm*—Leydig, Voit & Mayer

[57] ABSTRACT

A hanger assembly, used for displaying merchandise in front of a perforated horizontal shelf, includes an elongated plate having a mounting anchor for attaching to the shelf, two depending wings for holding labels, and two hooks struck out of the wings for suspending display merchandisers. The hooks and the wings are oriented so that both the merchandisers and the labels are clearly visible from a line of sight parallel to the shelf, thereby increasing the potential sales of the merchandise supported from the hanger.

6 Claims, 1 Drawing Sheet

HEAVY DUTY HANGER ASSEMBLY WITH LABEL WINGS AND ORIENTING HOOKS

BACKGROUND OF THE INVENTION

This invention relates to a display hanger and, more particularly, to a hanger used to suspend merchandise from a horizontal shelf for viewing by store customers. Still more particularly, the hanger is adapted to hold plastic strip merchandisers of the general type disclosed in Fast U.S. Pat. No. 4,546,943.

Most conventional methods of supporting plastic strip merchandisers orient the strip, merchandise attached thereto, and a corresponding label such that they face into the customer aisle provided between columns of shelves. As a result, the visibility of the merchandise is diminished because the flow of customer traffic is perpendicular to the direction in which the strip merchandisers are facing.

SUMMARY OF THE INVENTION

The general aim of the present invention is to provide a new and improved display hanger which vertically supports plastic strip merchandisers so that both the merchandise and indicia labels face the flow of customers as they pass through store aisles.

A more detailed objective of the invention is to achieve the foregoing by providing a display hanger comprising an elongated plate which mounts to a shelf, and two depending wings each formed with a hook on its inboard side. Each hook terminates in an open end spaced laterally inwardly from the wing, thereby enabling merchandise to be placed on and suspended from the hanger such that it may be easily viewed from a direction parallel to the shelf. The depending wings face laterally so that an indicia label affixed to the outboard side of each wing may be easily viewed.

These and other objects and advantages of the invention will become more apparent from the following detailed description when taken in conjunction with the accompanying drawings.

DETAILED DESCRIPTION OF THE PREFERRED EMBODIMENTS

Figure 1:
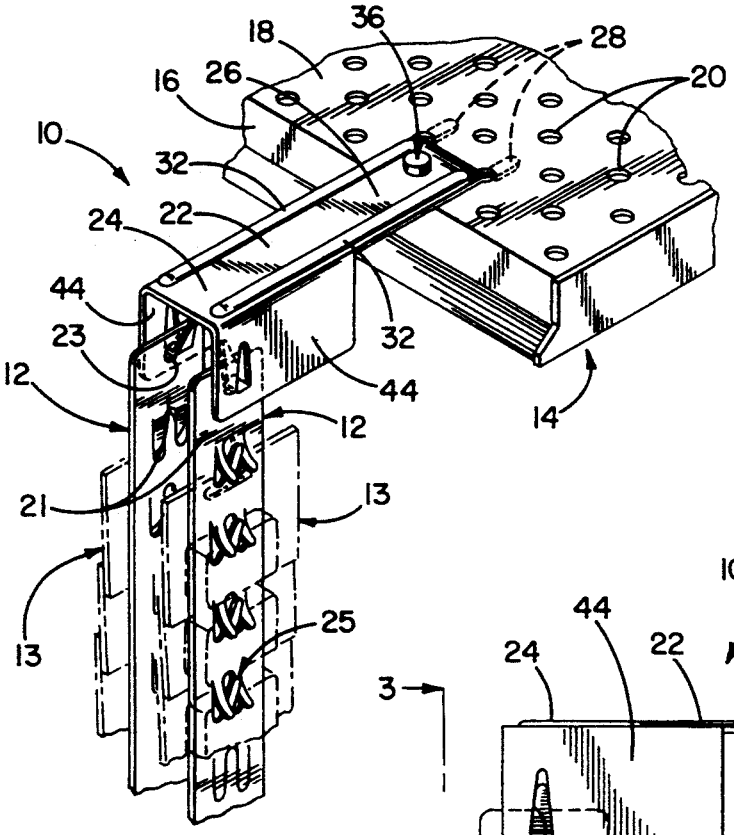
FIG. 1 is a fragmentary perspective view of a typical shelf equipped with a new and improved display hanger incorporating the features of the present invention.

For purposes of illustration, the invention has been shown in the drawings as incorporated in a display hanger 10 for supporting strip merchandisers 12 which are particularly suited for displaying merchandise 13 in front of a horizontal shelf 14 having a front edge 16 and having a horizontal top surface 18 which is formed with several transversely extending rows of transversely spaced and vertically extending holes 20. The distance between transversely spaced holes is typically one inch, with the holes of adjacent rows being typically offset by one-half inch.

Each merchandiser 12 is an elongated plastic strip 21 comprising an upper end portion formed with a hole 23 for suspending the merchandiser from the hanger 10 and formed with a plurality of integral means 25 spaced along the strip below the hole to releasably grip the merchandise 13 so that customers can easily remove the merchandise for purchase. Reference may be made to the aforementioned Fast patent for a more detailed disclosure of merchandise holding means generally similar to the means 25.

Figure 4:
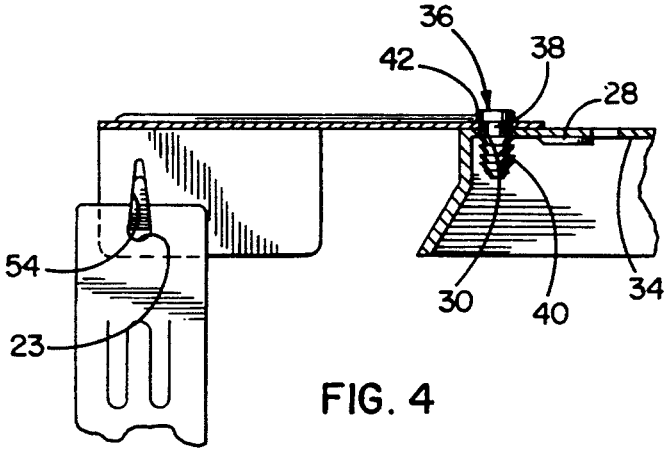
FIG. 4 is a fragmentary cross-section taken substantially along the line 4—4 of FIG. 3.

The display hanger 10 comprises an elongated metal plate defining a support arm 22 having first and second end portions 24 and 26, respectively, the end portion 26 having integral means for mounting the arm in two of the vertically extending holes 20 in the shelf 14. The mounting means comprises two parallel prongs 28 formed integrally with and extending from the arm and, optionally, a vertically extending locking hole 30 (best seen in FIG. 4) located between and spaced forwardly from the prongs. The arm 22 is formed with embossed ribs 32 extending along the lateral margins of the arm from the first end portion 24 to the second end portion 26. Each rib projects upwardly so as to reinforce the arm and reduce vertical flexing thereof when heavy merchandise is displayed.

Figure 2:
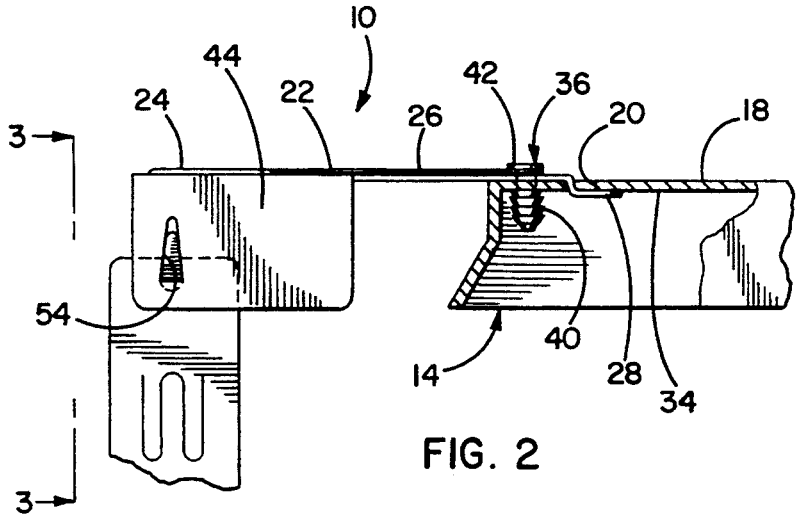
FIG. 2 is a fragmentary side view of the shelf, the display hanger and the merchandisers, part of the shelf being broken away and shown in section.

To attach the display hanger 10 to the shelf 14 (FIG. 2), the ends of the prongs 28 are inserted downwardly through two adjacent vertically extending holes 20 located inwardly from the edge 16 of the shelf. The hanger is then maneuvered such that the top of the prongs are seated against the bottom side 34 of the shelf while a short section of the arm 22 extending forwardly from the holes rests on the top surface 18 of the shelf. The vertically extending hole 30 formed in the arm 22 is aligned with a hole 20 in the row located forwardly of the first holes, such that an optional locking push pin 36 can be inserted through the aligned holes. The push pin is preferably made of plastic and comprises a shank 38 (FIG. 4) having a head 42 at one end, with axially spaced and radially extending annular rings 40 progressing along the shank from the head toward the other end thereof. The annular rings both reduce in diameter and taper upon progressing away from the head so as to reduce the force needed to install the pin. The push pin is installed by inserting the pin in the aligned holes such that the annular rings pass through the holes and the head is seated against the arm 22. The annular ring in proximity to the head, being of larger diameter than the holes, engage the bottom 34 of the shelf 14. Thus, the hanger is securely connected to the shelf.

In accordance with the present invention, the support arm 22 extends forwardly from the shelf 14 and is formed with two wings 44 which depend from the lateral margins of the first end portion 24. Each wing is formed with an inwardly struck hook 46 (FIG. 3) oriented so as to suspend the strip merchandiser 12 parallel to the arm, thereby facing the flow of customers. Moreover, to provide customers and employees with a quick reference to merchandise information, the outboard sides of the wings are substantially flat so that labels (not shown) can be affixed thereto and viewed from the same direction as the merchandisers. Each wing preferably is rectangular in shape.

Figure 3:
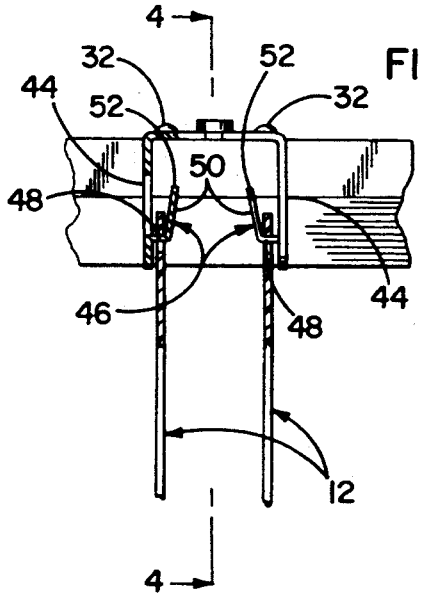
FIG. 3 is a fragmentary front view of the shelf, the display hanger and the merchandisers, part of the hanger and one suspended merchandiser being shown in section.

As shown most clearly in FIG. 3, each support hook 48 is formed with a first segment 48 extending laterally from the respective wing. A second segment 50 is integrally formed with the first segment of each hook and extends upwardly and inwardly from the first segment and toward the arm 22. Each second segment has an upper free end 52 spaced laterally from the adjacent wing to enable a merchandiser 12 to be placed on and suspended from the hook 46. A merchandiser may be suspended from each hook, such that the two merchandisers face in opposite lateral directions. An indicia label (not shown) is affixed to the outboard side of each wing such that it is visible from a direction parallel to the shelf. The label may be positioned to cover the opening 54 left in the wing as a result of striking the hook inwardly therefrom.

From the foregoing, it will be apparent that the present invention brings to the art a heavy duty display hanger capable of supporting two oppositely facing strip merchandisers 12 which may be loaded with relatively heavy merchandise. By virtue of the hooks 46 being located on the inboard sides of the wings 44, the outboard sides of the wings are left flat and unobstructed so that indicia labels may be easily placed on and displayed from the wings. The wings and hooks are oriented such that both the merchandise and the labels are within the direct sight of customers as they progress down shopping aisles.

I claim:

1. A display hanger for suspending merchandise forwardly of a generally horizontal display shelf having a plurality of vertically extending hole means formed therein, said hanger comprising a generally horizontal metal support plate, said plate having first and second end portions, said first end portion having integral support means for retaining said hanger in said hole means, two substantially flat wings formed integrally with and projecting downwardly from opposite lateral margins of said plate adjacent said second end portion for holding indicia labels, each of said wings having a lower edge, a support hook struck from each of said wings above the lower edge of the wing and projecting inwardly from the wing, each of said hooks having a first segment extending inwardly from the respective wing and spaced above said lower edge and having a second segment formed integrally with said first segment and projecting upwardly from said first segment, each of said second segments having an upper free end spaced inwardly from the respective wing to enable merchandise to be placed on and supported from said hook.

2. A display hanger as described in claim 1, where said first end portion of said plate includes a vertically extending locking hole, said locking hole being positioned such that said locking hole is axially aligned with one of said hole means in said shelf when said support means is retained in other ones of said hole means, and a push pin projecting through said locking hole and into said one hole means to help retain said hanger on said shelf

3. A display hanger as described in claim 1, where said support means comprises two parallel prongs formed integrally with and extending from said plate, said prongs being parallel to each other such that they align with two of said hole means, each of said prongs having a downwardly extending step so that the top of each prong engages the bottom of said shelf and the bottom of said plate rests on the top of said shelf when said hanger is installed on said shelf.

4. A display hanger as described in claim 1, further including two elongated and generally vertical plastic strips each having an upper end portion and each having vertically spaced .integral means located below said upper end portion for supporting said merchandise, and holes formed through the upper end portions of said strips to enable said strips to be placed on said hooks and oriented such that both of said strips face in opposite lateral directions.

5. The combination of (A) two strip merchandisers and (B) a hanger for suspending said merchandisers forwardly of a generally horizontal display shelf having a plurality of vertically extending hole means formed therein, each of said strip merchandisers comprising an elongated and generally vertical plastic strip having an upper end portion and having vertically spaced integral means located below said upper end portion for supporting said merchandise, and holes formed through the upper end portions of said strips, said hanger comprising a generally horizontal metal support plate, said plate having first and second end portions, said first end portion having integral support means for retaining said hanger in said hole means, two substantially flat integral wings projecting downwardly from opposite lateral margins of said plate adjacent said second end portion for holding indicia labels, a support hook struck from each of said wings and projecting inwardly therefrom, each of said hooks having a first segment extending inwardly from the respective wing and a second segment formed integrally with said first segment and projecting upwardly therefrom, each of said second segments having an upper free end spaced inwardly from the respective wing to enable said strips to be placed on said hooks and oriented such that both of said strips face in opposite lateral directions.

6. A display hanger for suspending merchandise forwardly of a display member having a plurality of hole means formed therein, said hanger comprising a generally horizontal metal support plate, said plate having first and second end portions, said first end portion having integral support means for retaining said hanger in said hole means, two substantially flat wings formed integrally with and projecting downwardly from opposite lateral margins of said plate adjacent said second end portion for holding indicia labels, each of said wings having a lower edge, a support hook struck from each of said wings above the lower edge of the wing and projecting inwardly from the wing, each of said hooks having a first segment extending inwardly from the respective wing and spaced above said lower edge and having a second segment formed integrally with said first segment and projecting upwardly from said first segment, each of said second segments having an upper free end spaced inwardly from the respective wing to enable merchandise to be placed on and supported from said hook.

* * * * *